US011008893B2

(12) United States Patent
Bencini et al.

(10) Patent No.: US 11,008,893 B2
(45) Date of Patent: May 18, 2021

(54) SECTOR FOR THE ASSEMBLY OF A STAGE OF A TURBINE AND CORRESPONDING MANUFACTURING METHOD

(71) Applicant: Nuovo Pignone Srl, Florence (IT)

(72) Inventors: Giacomo Bencini, Florence (IT); Fabio Fornaciari, Florence (IT); Leonardo Tognarelli, Florence (IT); Pierluigi Tozzi, Florence (IT)

(73) Assignee: Nuovo Pignone SRL, Florence (IT)

( * ) Notice: Subject to any disclaimer, the term of this patent is extended or adjusted under 35 U.S.C. 154(b) by 0 days.

(21) Appl. No.: 15/524,028

(22) PCT Filed: Oct. 30, 2015

(86) PCT No.: PCT/EP2015/075254
§ 371 (c)(1),
(2) Date: May 3, 2017

(87) PCT Pub. No.: WO2016/071224
PCT Pub. Date: May 12, 2016

(65) Prior Publication Data

US 2017/0328237 A1 Nov. 16, 2017

(30) Foreign Application Priority Data

Nov. 3, 2014 (IT) ..... MI2014A001877

(51) Int. Cl.
*F01D 25/24* (2006.01)
*F01D 9/04* (2006.01)
(Continued)

(52) U.S. Cl.
CPC ..... *F01D 25/246* (2013.01); *F01D 9/04* (2013.01); *F01D 9/041* (2013.01); *F01D 9/042* (2013.01);
(Continued)

(58) Field of Classification Search
CPC . F01D 9/04; F01D 9/041; F01D 9/042; F01D 25/246; F01D 9/06
See application file for complete search history.

(56) References Cited

U.S. PATENT DOCUMENTS 3,302,926 A * 2/1967 Bobo ..... F01D 9/042 415/136
5,174,715 A * 12/1992 Martin ..... B23P 15/006 29/464
(Continued)

FOREIGN PATENT DOCUMENTS

CN 1896465 A 1/2007
CN 101146980 A 3/2008
(Continued)

OTHER PUBLICATIONS

Machine Translation and First Office Action and Search issued in connection with corresponding CN Application No. 201580059803.7 dated Aug. 22, 2018.
(Continued)

*Primary Examiner* — Peter J Bertheaud
(74) *Attorney, Agent, or Firm* — Baker Hughes Patent Organization

(57) ABSTRACT

A sector for the assembly of a stage of a turbine comprises a central and a peripheral portion; a plurality of blades attached between the central and the peripheral portions; a first and a second side opposite to each other, the first side is configured to join with the second side of another sector, the first side is provided with a first connecting portion and the second side is provided with a second connecting portion configured to mate with a first connecting portion of a first side of another sector.

13 Claims, 5 Drawing Sheets

(51) Int. Cl.
*F01D 9/06* (2006.01)
*F01D 11/00* (2006.01)

(52) U.S. Cl.
CPC ..... *F01D 9/06* (2013.01); *F01D 9/065* (2013.01); *F01D 11/00* (2013.01); *F01D 11/005* (2013.01); *F01D 11/006* (2013.01); *F05D 2230/60* (2013.01); *F05D 2230/64* (2013.01)

(56) References Cited

U.S. PATENT DOCUMENTS

| | | | | |
|---|---|---|---|---|
| 6,890,151 | B2 * | 5/2005 | Bertrand | F01D 9/042 415/209.2 |
| 8,092,165 | B2 * | 1/2012 | Bouchard | F01D 9/02 29/889.22 |
| 8,128,354 | B2 * | 3/2012 | Hansen | F01D 5/225 415/191 |
| 8,511,982 | B2 * | 8/2013 | Hart | F01D 9/042 415/209.2 |
| 2003/0185673 | A1 | 10/2003 | Matsumoto et al. | |
| 2006/0245715 | A1 | 11/2006 | Matsumoto et al. | |
| 2010/0129211 | A1 | 5/2010 | Hart et al. | |
| 2013/0149106 | A1 | 6/2013 | Giusti | |

FOREIGN PATENT DOCUMENTS

| | | | |
|---|---|---|---|
| CN | 103119249 | A | 5/2013 |
| CN | 103422903 | | 12/2013 |
| DE | 10 2011 117 755 | A1 | 4/2007 |
| DE | 102011117755 | A1 | 5/2012 |
| EP | 2 666 969 | A1 | 11/2013 |
| FR | 2 978 798 | A1 | 2/2013 |
| JP | H8-158810 | A | 6/1996 |
| JP | H09-133003 | A | 5/1997 |
| WO | 2006/100256 | A1 | 9/2006 |
| WO | 2012/041651 | A1 | 4/2012 |

OTHER PUBLICATIONS

Italian Search Report and Written Opinion issued in connection with corresponding IT Application No. MI2014A001877 dated Mar. 26, 2015.

International Search Report and Written Opinion issued in connection with corresponding PCT Application No. PCT/EP2015/075254 dated Jan. 15, 2016.

International Preliminary Report on Patentability issued in connection with corresponding PCT Application No. PCT/EP2015/075254 dated May 9, 2017.

* cited by examiner

SECTOR FOR THE ASSEMBLY OF A STAGE OF A TURBINE AND CORRESPONDING MANUFACTURING METHOD

BACKGROUND TO THE INVENTION

The present invention relates to a sector for the assembly of a stage of a turbine. In particular, an embodiment of the present invention relates to a sector for the assembly of a stage of a steam turbine. Specifically, the stage assembled by these sectors has hollow blades.

In turbines, partial steam condensation occurs at their last stage or stages.

In particular, condensation occurs on the airfoil portion of the stator blades of a so-called "condensing stage", typically the last stage of the turbine.

If droplets are generated as a consequence of condensation, they leave the static stator blades and they hit the rotating rotor blades; therefore, damages to the rotor blades may occur.

In order to reduce the damages caused by the droplets, the rotation speed of the rotor blades may be reduced. However, in this way the efficiency of the turbine is also reduced.

Alternatively, in order to reduce any damage on the rotor blades, solutions exist for collecting the condensation before the generation of droplets.

The most typical of these solutions consists in using hollow stator blades where condensation is likely to occur, providing holes and/or slots through the airfoil portion of the blades extending from the airfoil surface to the internal cavity, and sucking from the internal cavity so to that any condensation leaves the airfoil surface and enters the internal cavity. In this way, the release of droplets can be highly reduced.

A stage of a turbine is known. Such stage is manufactured by a method, which comprises the steps of machining an inner and an outer ring having each a respective channel. Each of these rings has an internal surface with a plurality of holes in fluid communication with the channel. A plurality of turbine blades is manufactured, each blade having a respective opening and a hollow cavity in fluid communication with the external environment through such opening.

The blades are then welded to the rings. Specifically, each hole in a single ring is placed in fluid communication with the cavity of a respective blade.

As a result, in the assembled stage the condensed water can be extracted through the opening of a blade, thus flowing into the cavity and then into the channel of one of the two rings.

BRIEF DESCRIPTION OF THE INVENTION

A first embodiment of the present invention is therefore related to a sector for the assembly of a stage of a turbine. Such sector comprises a central and a peripheral portion. A plurality of blades is attached between the central and the peripheral portions. The sector also has a first and a second side, opposite to each other. The first side is configured to join with the second side of another sector. Specifically, the first side is provided with a first connecting portion, while the second side is provided with a second connecting portion. The second connecting portion is configured to mate with a first connecting portion of a different sector.

Further details and specific embodiments will refer to the attached drawings, in which.

DETAILED DESCRIPTION

Figure 1:
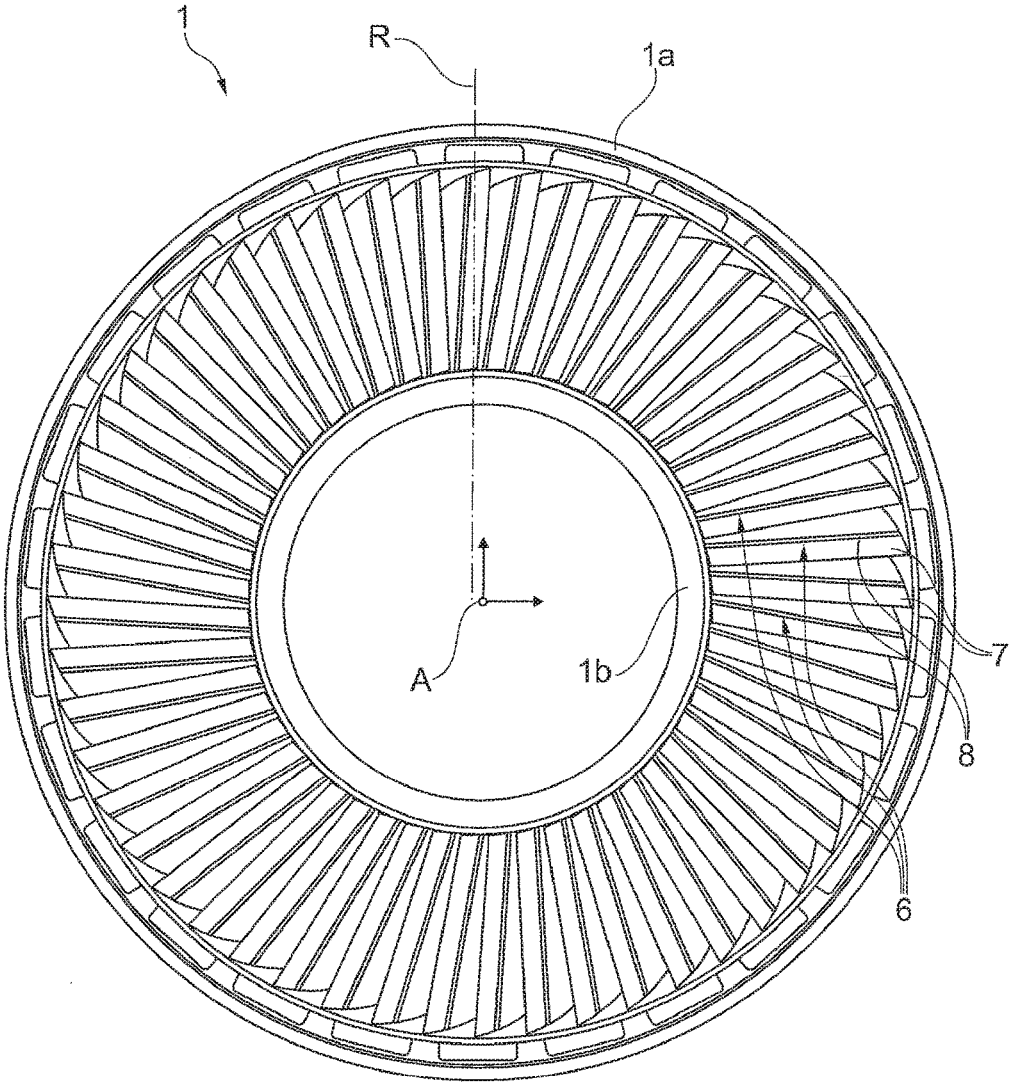
FIG. 1 is a front view of a stage of a turbine assembled from a plurality of sectors according to an embodiment of the present invention.
Figure 2:
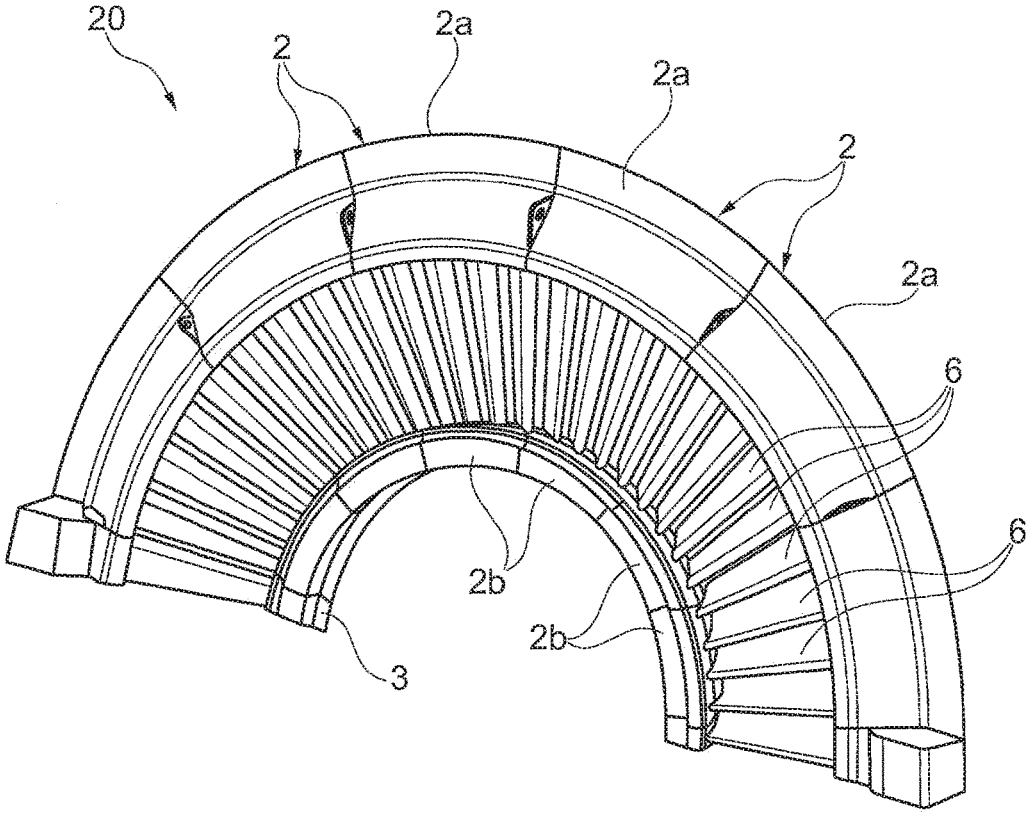
FIG. 2 is a rear view of a detail of the stage of a turbine from FIG. 1.

The following description of exemplary embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Therefore, a sector for the assembly of a stage of a turbine will be described in detail with reference to the attached drawings, where it will be indicated with the number 2. The stage of the turbine will be indicated with the number 1. The stage 1 is in particular a stage of a steam turbine. However, in a different embodiment of the present invention, not shown in the drawings, the same technical solution can be applied to a stage of a gas turbine.

The stage 1 has a central axis "A". The stage has a central zone 1*a* and a peripheral zone 1*b* with respect to the central axis "A". In other words, the central zone 1*a* can be considered an internal part of the stage 1, while the peripheral zone 1*b* can be understood as an external part of the stage 1 with respect to the central axis "A". The flow of fluid (gas in the case of a gas turbine, steam in the case of the steam turbine) inside the turbine is directed substantially along the central axis "A". From the central axis "A" the stage 1 develops outwardly, mainly on a reference plane perpendicular to the central axis "A". On this reference plane a plurality of radial directions "R" can be defined, each lying on the reference plane and intersecting the central axis "A" of the stage 1. These radial directions "R" will be used as reference in a following part of the present disclosure.

The stage 1 is provided with a plurality of blades 6. Each blade 6 projects radially from the central zone 1*a* to the peripheral zone 1*b*. Additionally, each blade 6 has an external surface 7, which is defined by an airfoil whose geometrical parameters are chosen depending on the specific application.

At least one of the blades 6, in an embodiment several blades 6 and more, in an embodiment all of them, have an opening 8 on the external surface 7. These openings 8 comprise a plurality of slits 25, each oriented radially along the blade 6 so that, in operation, they are transversal with respect to the fluid flow. Indeed, the blades 6 are also provided with a cavity 9 located in an internal zone. In other words, the blades 6 are hollow.

In detail, the cavity 9 extends along at least a portion of the radial length of the blade 6, in an embodiment along the full radial length of the blade 6. Each opening 8 likewise extends along at least a portion of the radial length of the blade 6. In the context of the present disclosure, by "radial length" is meant the length of the blade 6 along a radial direction, namely a direction perpendicular to the central axis "A" of the stage 1 and projecting from it. The opening 8 is configured so as to place the cavity 9 in fluid communication with a volume outside the blade 6.

The cavity 9 inside the blade 6 has an internal surface 10. The shape of the internal surface 10 can be defined in any way known to the person skilled in the art, is transversal to the blade 6. It is to be noted that, according to an embodiment of the invention, the blades 6, the central 2*b* and the peripheral portion 2*a* are built as a single block of material. In other words, the sector 2 can be built as a single block of material. In the context of the present disclosure, making the sector 2 "as a single block" also comprises any kind of additive manufacturing, where small particles of material are fused together to define the sector 2.

The stage 1 is provided with at least one channel 5, which can be located in the peripheral zone 1*a* and/or in the central zone 1*b* of the stage 1. With additional detail, the channel 5 can be placed in fluid connection with an internal zone of the turbine where the stage 1 is installed. The channel 5 is placed in fluid communication with the cavities 9 of the blades 6.

The channel 5 itself can be placed in fluid connection with a low pressure zone (not shown) outside the turbine. In this way, part of the flow inside the turbine can be sucked through the openings 8, into the cavities 9 and then into the channel 5, thereby removing condensed liquid from the external surface 7 of the blades 6.

According to one embodiment of the invention, the stage 1 comprises a plurality of sectors 2. In each sector 2 is geometrically a circular sector, i. e. a sector of a circle or, more precisely, of a circular ring. Each sector 2 comprises a central 2*b* and a peripheral portion 2*a*, as well as a plurality of the above mentioned blades 6. Each blade 6 is attached to the central 2*b* and to the peripheral portion 2*a*.

Figure 5A:
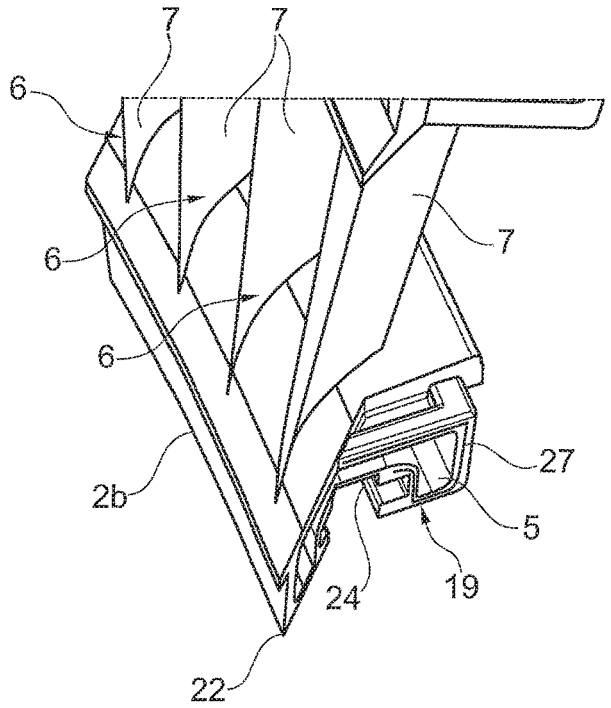
Figure 5B:
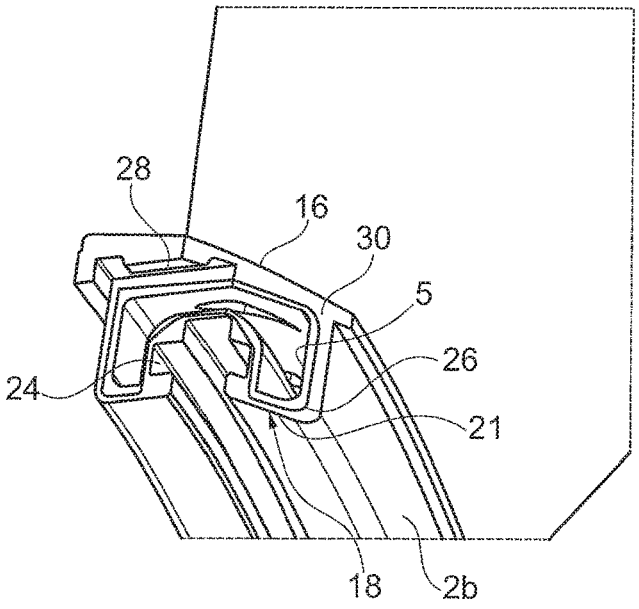

With additional detail, the sector 2 is provided with a seat 24, shown in FIGS. 5A and 5B. The seat 24 develops along a circular direction. Also, the seat 24 is placed on the central portion 2*b* of the sector 2 in such a way that it faces the central axis "A". As is shown in FIG. 5*b*, the channel 5 partially envelops the seat 24. The seat 24 has the purpose of containing the seals for a rotor of the turbine in which the stage 1 can be installed.

Figure 3:
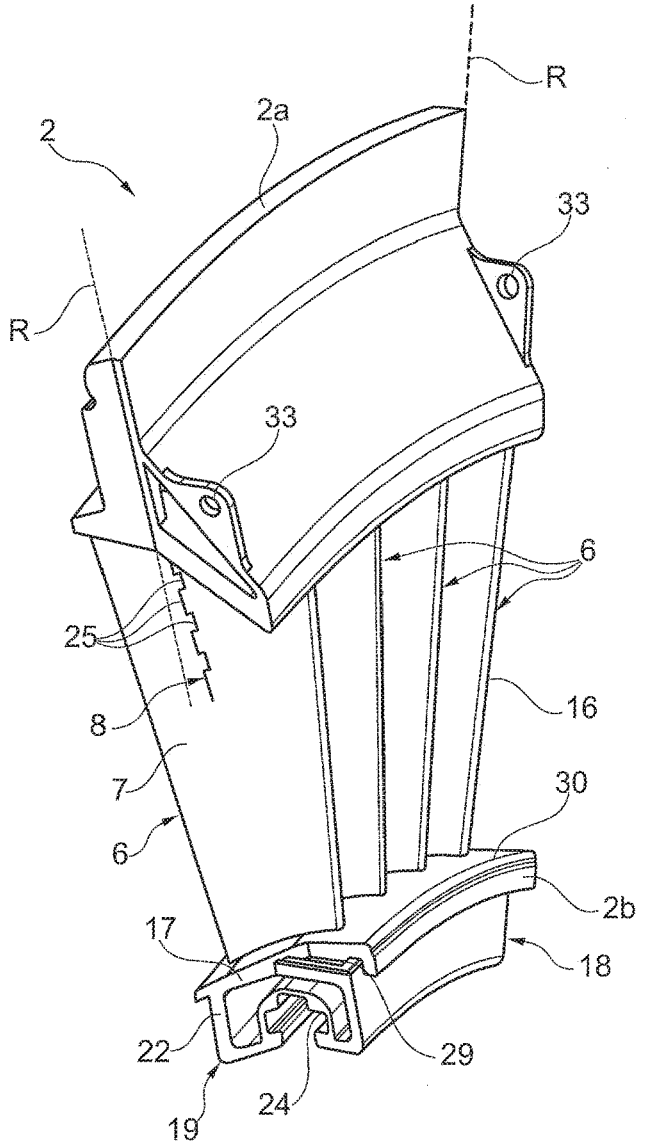
FIG. 3 is a perspective view of a sector for the assembly of a stage of a turbine according to an embodiment of the present invention.
Figure 3A:
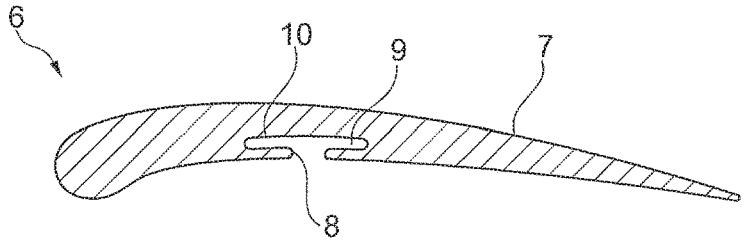
FIG. 3A is a sectional view of a detail of the sector from FIG. 3.

With reference to FIG. 3, the sector 2 has a first 16 and a second side 17. These sides 16, 17 are opposite to each other. The first 16 and the second side 17 define each a respective interface plane. Each interface plane is defined by a respective radial direction "R", shown in FIG. 3, and the central axis "A" of the sector 2. The first side 16 is configured to join with the second side 17 of a different sector 1.

Specifically, the first side 16 is provided with a first connecting portion 18. The second side 17 is provided with a second connecting portion 19, which is configured to mate with a first connecting portion 18 of a first side 16 of another sector 1. In other words, the first 18 and the second connecting portions 19 have a complementary shape. Indeed, the connecting portions 18, 19 are designed in such a way that they can lock onto each other, therefore avoiding the need to weld the sectors 2. The first 18 and the second connecting portions 19 are located on the central portion 2*b* of the sector 2.

With more detail, the second connecting portion 19 has a protrusion 22, which extends from the radial plane of the second side 17. As shown in FIG. 5A, the protrusion 22 is wedge shaped so that the front part of the second connecting portion 19 can be considered as a "cut" of the stage 1 along a radial plane, while the back side, which defines the protrusion 22, can be considered "cut" along a plane which intersects the radial plane at an angle. The angle of intersection is defined considering the geometry and the orientation of the blades 6 so that the "cut" does not intersect the blades 6.

The first connecting portion 18 has a recess 21, which extends inward from the radial plane of the first side 16. As can be seen in FIGS. 5A and 5B, the recess 21 is shaped complementary with respect to the protrusion 22.

Also, in order to lock the connecting portions 18, 19 together, the second connecting portion 19 has a socket 29, while the first connecting portion has a key 28 which is configured to be inserted into the socket 29.

With reference to FIGS. 5A and 5B, the central portion 2*b* of the sector 2 has a radially outward wall 30, on which the blades 6 are directly attached. This wall 30 also partially defines the above described channel 5. The key 28 and the socket 29 are both located on the wall 30. Specifically, the socket faces radially outward, while the key 28 projects radially inward from the wall 30. The key 28 and the socket 29 are complementary shaped with respect to each other.

The first connecting portion 18 comprises a groove 26 which surrounds at least in part the channel 5. Similarly, the second connecting portion 19 comprises a tongue 27 which surrounds at least in part the channel 5. Indeed, as shown in FIGS. 5A and 5B, the tongue 27 and the groove 26 trace a perimeter of the channel 5. The tongue 27 is configured to be inserted into the groove 26 of another sector 2. A sealing material, in an embodiment a sealing paste and silicone, can be placed between the tongue 27 and the groove 26 during assembly, in order to join two channels 5 of the respective sectors 2 in a fluid-tight manner. In an embodiment, this allows to avoid welding the sectors 2.

In an alternative embodiment, not shown, the tongue 27 can be placed on the first connecting portion 18, while the groove 26 is placed on the second connecting portion 19.

Figure 4A:
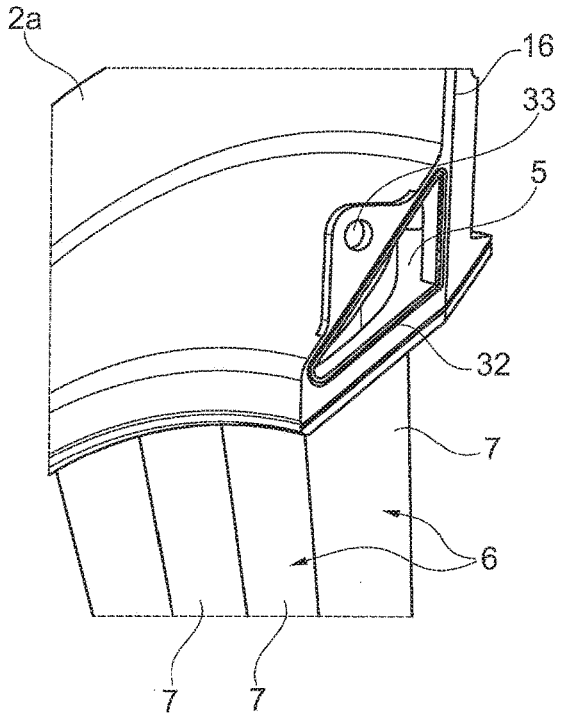
FIGS. 4A, 4B, 5A and 5B are each a view of a respective detail of the sector of FIG. 3.
Figure 4B:
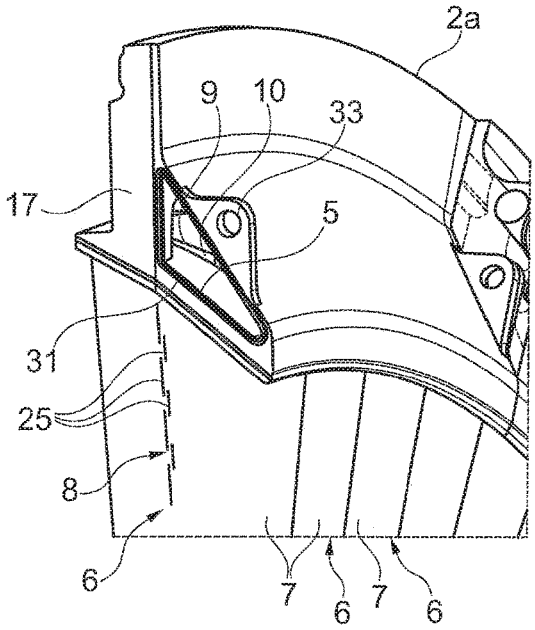

With reference to FIGS. 4A and 4B, the sector 2 also comprises a further groove 31, placed on the first side 16, and a further tongue 32 placed on the second side 17. These are placed on the peripheral portion 2*a*. The further groove 31 and the further tongue 32 surround the channel 5 on the peripheral portion 2*a*, in the same manner as the previously discussed tongue 27 and groove 26 surround the channel 5 in the central portion 2*b*.

Two holes 33 are placed on the sides 16, 17 of the sector 2 on the peripheral portion 2*a*. The holes are configured to be aligned each with a respective hole 33 of other sector 2. In this way a connection element (not shown in the drawings), in an embodiment a bolt, can be inserted in the holes 33 in order to join the adjacent sectors 2.

It is to be noted that according to an embodiment of the present invention, the stage 1 comprises four sectors 2, each having an angular aperture of 90° with respect to the central axis "A". Other embodiments are possible, comprising different numbers of sectors 2 which have different angular apertures.

Another embodiment of the present invention relates to a method for manufacturing a stage 1 of a turbine. Such method comprises the steps of providing a plurality of sectors 2 as described above. The sectors 2 are then joined together so as to define two half-stages 20.

The step of joining the sectors 2 comprises the step of mating a second connecting portion 19 on the second side 17 of at least one sector to a first connecting portion 18 on the first side 16 of an adjacent sector 2. In an embodiment, all the sectors which define a single half-stage 20 are connected in this way.

Also, the tongue 27 on the second connecting portion 19 is inserted into the groove 26 on the first connecting portion 18. Similarly, the further tongue 32 is inserted into the further groove 31. In performing this step the sealing material is placed between the tongue 27 and the groove 26 and between the further tongue 32 and the further groove 31. Thus the portions of the channels 5 of the respective sectors 2 can be joined in a fluid-tight manner without welding.

By joining two half-stages 30, the above described stage 1 can be assembled.

What is claimed is:

1. A sector for the assembly of a stage of a turbine comprising:

a central portion;

a peripheral portion;

a plurality of blades attached between the central portion and the peripheral portion;

a first side and a second side opposite to each other, the first side configured to join with a second side of another sector, the first side provided with a first connecting portion and the second side provided with a second connecting portion configured to mate with a first connecting portion of a first side of another sector, wherein at least one of the blades has an opening on a respective external surface, said blade having an internal cavity in fluid communication with said opening, the sector having a channel in fluid communication with the internal cavity, said channel being located inside said central portion.

2. A sector according to claim 1, wherein the first connecting portion and the second connecting portion are located on the central portion.

3. A sector according to claim 1, wherein the first side and the second side define each a respective interface plane, each interface plane being also defined by a radial direction and by a central axis of said sector.

4. A sector according to claim 3, wherein the said second connecting portion has a protrusion extending from the interface plane of the second side, the first connecting portion having a recess extending inward from the interface plane of the first side.

5. A sector according to claim 1, wherein the first connecting portion comprises a groove surrounding at least in part said channel; the second connecting portion comprising a tongue surrounding at least in part said channel, said tongue being configured to be inserted into the groove of another sector.

6. A sector according to claim 1, wherein the second connecting portion has a socket, the first connecting portion having a key configured to be inserted into the socket to lock said first and second connecting portions.

7. A sector according to claim 6, wherein said key has a complementary shape with respect to said socket.

8. A sector according to claim 6, wherein the key and the socket are located on a radially outward wall of a channel.

9. A sector according to claim 1, wherein the central and peripheral portions are built as a single block of material.

10. A sector according to claim 5, further comprising a further groove placed on the first side; a further tongue placed on the second side.

11. A sector according to claim 10, wherein said further groove and said further tongue are placed on the peripheral portion.

12. A sector according to claim 10, also comprising holes placed on the first side and the second side on the peripheral portion, said holes being each configured to be aligned with holes of another sector to receive a connection element.

13. A method for manufacturing a turbine comprising a plurality of sectors, each sector comprising a central portion, a peripheral portion, a plurality of blades attached between the central portion and the peripheral portion, a first side and a second side opposite each other, the first side configured to join with a second side of another sector, the first side having a first connecting portion and the second side having a second connecting portion, the method comprising:

joining the plurality of sectors to define two half-stages, said joining comprising mating the second connecting portion on the second side of at least one sector to the first connecting portion on the first side of an adjacent sector; and joining said half-stages to assemble a stage of the turbine, wherein the mating step comprises inserting a tongue on said second connecting portion into a groove on said first connecting portion, and placing a sealing material between the tongue and the groove to join two channels of the respective sectors in a fluid-tight manner.

* * * * *